US009254940B2

(12) United States Patent
Bray

(10) Patent No.: US 9,254,940 B2
(45) **Date of Patent: *Feb. 9, 2016**

(54) MULTI-COMPARTMENT RESEALABLE STORAGE BAG AND CONTAINER

(71) Applicant: MaBelle Bray, Studio City, CA (US)

(72) Inventor: MaBelle Bray, Studio City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/866,931

(22) Filed: Apr. 19, 2013

(65) Prior Publication Data

US 2013/0236128 A1 Sep. 12, 2013

Related U.S. Application Data

(63) Continuation-in-part of application No. 12/474,250, filed on May 28, 2009, now Pat. No. 8,449,186.

(60) Provisional application No. 61/056,440, filed on May 28, 2008.

(51) Int. Cl.

| | |
|---|---|
| ***B65D 30/22*** | (2006.01) |
| ***B65D 33/12*** | (2006.01) |
| ***B65D 33/00*** | (2006.01) |
| ***B65D 33/16*** | (2006.01) |
| ***B65D 25/04*** | (2006.01) |
| ***B65D 33/25*** | (2006.01) |

(52) U.S. Cl.

CPC ..... *B65D 33/12* (2013.01); *B65D 25/04* (2013.01); *B65D 31/12* (2013.01); *B65D 33/008* (2013.01); *B65D 33/16* (2013.01); *B65D 33/2591* (2013.01)

(58) Field of Classification Search

CPC . B65D 31/12; B65D 81/3261; B65D 33/2566
USPC ..... 383/38–40
See application file for complete search history.

(56) References Cited

U.S. PATENT DOCUMENTS

| | | | | |
|---|---|---|---|---|
| 2,276,765 | A * | 3/1942 | De Gree | 383/38 |
| 3,749,237 | A | 7/1973 | Dorton | |
| 6,071,010 | A * | 6/2000 | Chan | 383/2 |
| 6,254,907 | B1 | 7/2001 | Galomb | |
| 6,624,130 | B2 | 9/2003 | Giblin et al. | |
| D483,256 | S * | 12/2003 | Thurston | D9/663 |
| 8,109,672 | B1 * | 2/2012 | Ackerman et al. | 383/37 |

(Continued)

OTHER PUBLICATIONS

International Search Report dated Nov. 13, 2014, for PCT application No. PCT/US2014/034669.

*Primary Examiner* — Jes F Pascua
*Assistant Examiner* — Derek Battisti
(74) *Attorney, Agent, or Firm* — Mintz Levin Cohn Ferris Glovsky and Popeo, P.C.

(57) ABSTRACT

The subject matter disclosed herein relates to a storage apparatus having multiple compartments. In one aspect, a multi-compartment bag can be formed of a flexible material, and each compartment of the multi-compartment bag can have two or more seams and one resealable opening edge. The seams in each compartment can include at least one tearable seam that can include at least a perforated seam configured to physically separate one of the compartments from the multi-compartment bag. In another aspect, a multi-compartment container can be formed of a rigid material having one or more removable lids, an upper portion, and a lower portion. The upper portion and the lower portion can each have a plurality of compartments. The upper portion can be separated from the lower portion by an intermediate layer.

10 Claims, 15 Drawing Sheets

(56) References Cited

U.S. PATENT DOCUMENTS

| | | | | |
|---|---|---|---|---|
| 8,449,186 | B2 * | 5/2013 | Bray | 383/38 |
| 2002/0067865 | A1 * | 6/2002 | Stutzman | 383/38 |
| 2003/0031388 | A1 * | 2/2003 | Gipson et al. | 383/64 |
| 2004/0066982 | A1 * | 4/2004 | Urman et al. | 383/6 |
| 2004/0179754 | A1 * | 9/2004 | Taheri | 383/38 |
| 2004/0247208 | A1 | 12/2004 | Krohne | |
| 2006/0262997 | A1 * | 11/2006 | Lerner et al. | 383/38 |
| 2007/0026251 | A1 | 2/2007 | Umana | |
| 2007/0206888 | A1 | 9/2007 | Chang | |
| 2009/0034885 | A1 * | 2/2009 | McGruder | 383/37 |
| 2010/0142862 | A1 * | 6/2010 | Sam | 383/38 |

* cited by examiner

100

MULTI-COMPARTMENT RESEALABLE STORAGE BAG AND CONTAINER

CROSS-REFERENCE TO RELATED APPLICATIONS

The current application is a continuation-in-part of and claims the benefit of priority under 35 U.S.C. §120 of co-pending U.S. patent application Ser. No. 12/474,250, filed on May 28, 2009, and entitled "Multi-Compartment Resealable Storage Bag," which claims the benefit of U.S. provisional patent application No. 61/056,440, filed on May 28, 2008, and entitled "Multi-Compartment Resealable Storage Bag." The above-identified applications are incorporated by reference herein in their entirety for all purposes.

TECHNICAL FIELD

The subject matter described herein relates generally to a storage apparatus and, more particularly, to a storage bag and a storage container having multiple resealable compartments.

BACKGROUND

Resealable storage bags can be used to store a variety of items including, for example, perishable items (such as food, snacks, and the like) and non-food items (such as buttons, postage stamps, and the like). Because conventional storage bags generally have a single storage compartment, the variety of items that can be stored in these bags without mixing the items together is compromised. For example, when storing food a person may want to keep different types of perishables in separate bags (such as miniature carrots and slices of pizza). The same can also apply to the storage of household items (such as screws and nails). In order to accommodate the storage of these items, multiple storage bags may be needed in order to separate the different types of items from each other.

SUMMARY

In some implementations, a storage apparatus is provided for a bag/container having multiple resealable storage compartments.

In some implementations there is provided a storage apparatus having a multi-compartment bag formed of a flexible material. Each compartment of the multi-compartment bag has two or more seams and one resealable opening edge. The multi-compartment bag further includes a front surface, a back surface, and a generally rectangular peripheral edge defined by a top edge, a bottom edge, and opposing side edges. The seams in each compartment include at least one tearable seam that includes a perforated seam positioned between a first solid seam and a second solid seam. The perforated seam is configured to physically separate one of the compartments from the multi-compartment bag.

The above storage apparatus can, in some implementations, further include one or more of the following features.

The perforated seam can be positioned along a horizontal axis, a vertical axis, or at an angle.

The storage apparatus can include a resealing element. The resealing element can be selected from a group consisting of a zippered closure, a press lock, a magnetic closure, a snap closure, and a heat seal. The resealable opening edge can be sealed and unsealed using the resealing element.

The flexible material can be selected from a group consisting of hemp, cotton, cloth, burlap, mesh, plastic, and a laminated material. The flexible material can be water proof or moisture proof.

In some implementations, the storage apparatus can also include a first handle that includes a first hole positioned on the front surface, and a second handle that includes a second hole positioned on the back surface. The first hole and the second hole can be substantially aligned with each other.

Alternatively, the storage apparatus can include a first handle attached to the front surface at a front first position and a front second position, and a second handle attached to the back surface at a back first position and a back second position. The front first position and the back first position can be substantially aligned with each other. Likewise, the front second position and the back second position can be substantially aligned with each other.

The multi-compartment bag can further include two or more rectangular compartments in a lower portion of the multi-compartment bag. Each of the rectangular compartments can have their resealable opening edge along the bottom edge of the multi-compartment bag. The multi-compartment bag can have at least one pair of substantially right triangular compartments in an upper portion of the multi-compartment bag. Each of the right triangular compartments can be arranged such that one of their seams is a common sealed seam at their respective hypotenuses. Moreover, each of the right triangular compartments can have their resealable opening edge along the opposing side edges of the multi-compartment bag perpendicular to the bottom edge of the multi-compartment bag.

The multi-compartment bag can further include three or more rectangular compartments in an upper portion of the multi-compartment bag and three or more rectangular compartments in a lower portion of the multi-compartment bag.

The multi-compartment bag can further include one or more chambers disposed between the compartments of the multi-compartment bag. One or more chamber closures can be removably attached to each of the one or more chambers. The one or more chamber closures can be selected from a group consisting of a twist-off cap and a pop-off cap.

In some implementations there is provided a storage apparatus formed of a rigid material having one or more removable lids, an upper portion, and a lower portion. The upper portion includes at least an upper first compartment, an upper second compartment, and an upper third compartment. The upper first compartment is separated from the upper second compartment by an upper first divider, and the upper second compartment is separated from the upper third compartment by an upper second divider. The lower portion includes at least a lower first compartment, a lower second compartment, and a lower third compartment. The lower first compartment is separated from the lower second compartment by a lower first divider, and the lower second compartment is separated from the lower third compartment by a lower second divider. The upper portion is separated from the lower portion by an intermediate layer.

The above storage apparatus can, in some implementations, further include one or more of the following features.

The one or more removable lids can include a removable lid positioned over the compartments in the upper portion of the multi-compartment container. In this configuration, the intermediate layer can be configured to be removed from the multi-compartment container.

In some implementations, the one or more removable lids can include a removable upper lid positioned over the compartments in the upper portion of the multi-compartment container, and a removable lower lid positioned over the compartments in the lower portion of the multi-compartment container. In this configuration, the intermediate layer can be immovable.

The one or more removable lids can be configured to be sealed to the multi-compartment container using one or more snap closures or one or more magnetic closures.

The rigid material used to form the storage apparatus can be selected from the group consisting of hard plastic, glass, and pyrex.

The storage apparatus can further include a first handle attached to a front surface of the multi-compartment container at a front first position and a front second position, and a second handle attached to a back surface of the multi-compartment container at a back first position and a back second position. The front first position and the back first position can be substantially aligned with each other, and the front second position and the back second position can be substantially aligned with each other.

The details of one or more variations of the subject matter described herein are set forth in the accompanying drawings and the description below. Other features and advantages of the subject matter described herein will be apparent from the description, drawings, and the claims.

BRIEF DESCRIPTION OF THE DRAWINGS

The accompanying drawings, which are incorporated herein and constitute a part of this specification, show certain aspects of the subject matter disclosed herein and, together with the description, help explain some of the principles associated with the subject matter disclosed herein. In the drawings.

Like reference symbols in the various drawings indicate like elements.

DETAILED DESCRIPTION

The subject matter disclosed herein relates to a storage bag or container having multiple resealable compartments.

Figure 1A:
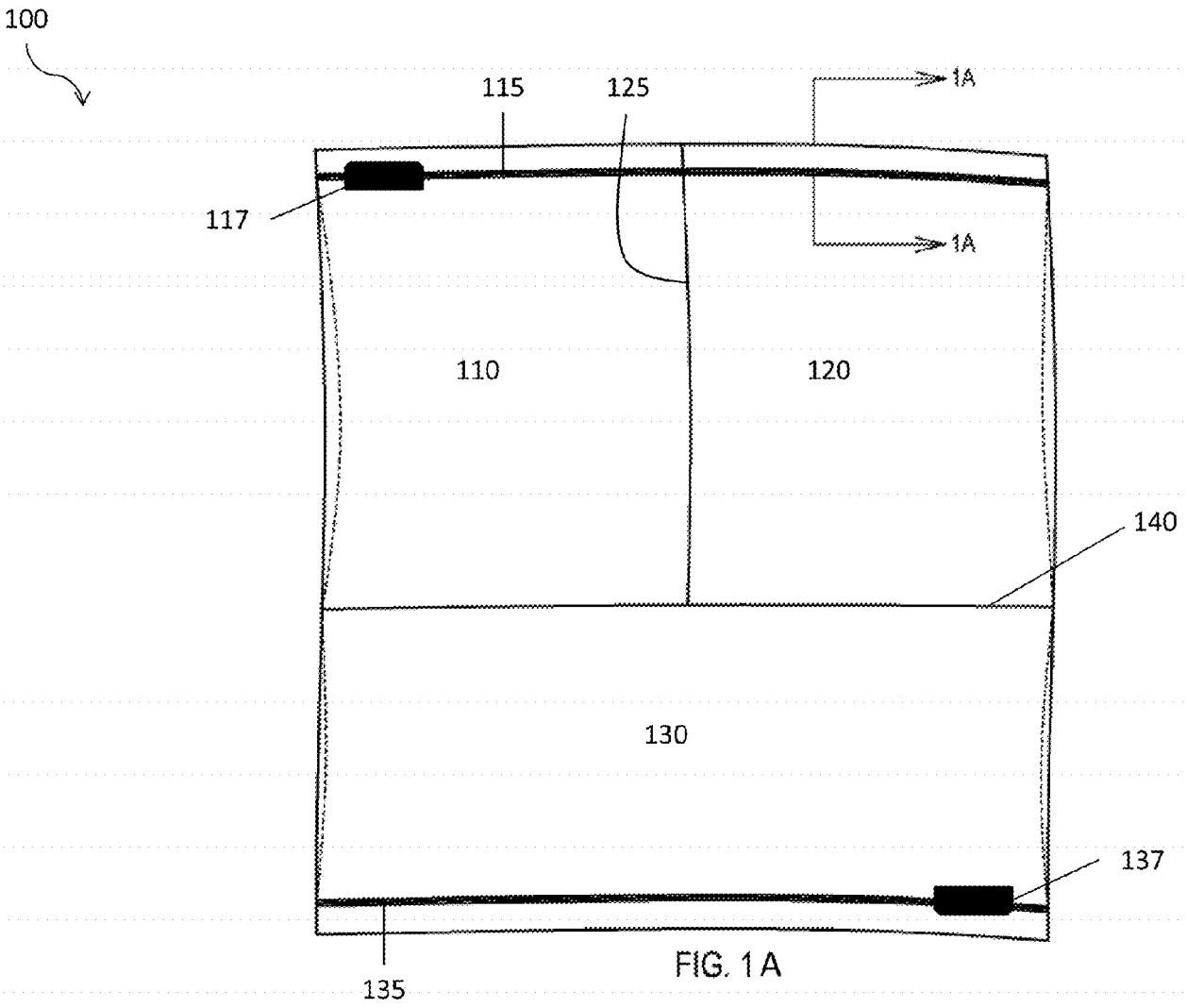
FIG. 1A illustrates a resealable bag having three compartments.

FIG. 1A illustrates an implementation of a resealable bag 100 having three compartments 110, 120, and 130. Resealable bag 100 can be made from high clarity polypropylene or other flexible, resilient and preferably translucent material. Using a substantially translucent material, such as polypropylene, can facilitate quick visual identification of the contents of bag 100. Bag 100 can be made with other materials including, for example, hemp, cotton, cloth, burlap, mesh, plastics of varying weight, and laminated materials. In some implementations, moisture proof or water proof materials can be used.

Compartments 110 and 120 can be positioned along top edge 115, and compartment 130 can be positioned along bottom edge 135. Each compartment can store different items with larger items placed in compartment 130. Seam 125 can separate compartments 110 and 120 from each other, and seam 140 can separate compartment 130 from compartments 110 and 120. Seams 125 and 140 can keep items placed in compartments 110, 120, and 130 in their designated space and prevent these items from shifting into other compartments.

Resealing elements 117 and 137 can be used to seal and unseal bag 100 along edges 115 and 135, respectively. If, for example, a user wishes to place items in compartments 110 and/or 120, the user can slide resealing element 117 along top edge 115 to unseal the desired compartment. In order to reseal bag 100, the user can slide resealing element 117 along top edge 115 in the reverse direction. Resealing element 137 can be operated in a similar manner to unseal and seal bottom edge 135. Although the implementation of FIG. 1 illustrates the use of a single resealing element 117 for compartments 110 and 120, different configurations are possible including, for example, the use of a separate resealing element for each compartment.

Figure 1B:
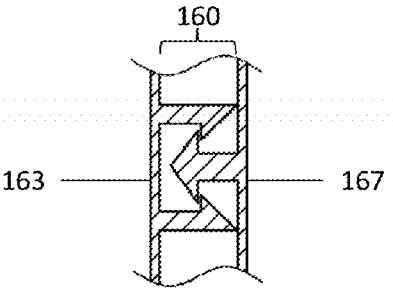
FIG. 1B illustrates a partial cross-sectional view of a resealing element.

FIG. 1B illustrates a partial cross-sectional view of a resealing element 160 which can correspond to any of the resealing elements described herein. Resealing element 160 can be implemented using a zippered closure that removably couples sides 163 and 167. For example, when a user slides resealing element 117 along top edge 115 from left to right in FIG. 1A, sides 163 and 167 of top edge 115 can be joined together to seal bag 100. Similarly, when resealing element 117 is moved in the opposite direction (for example, from right to left), sides 163 and 167 of top edge 115 can be separated to unseal bag 100. Although FIG. 1B illustrates the use of a zippered closure, resealing element 160 can be implemented with other types of closures including, for example, a press lock, a magnetic closure, a snap closure, a heat seal, and the like.

Figure 2A:
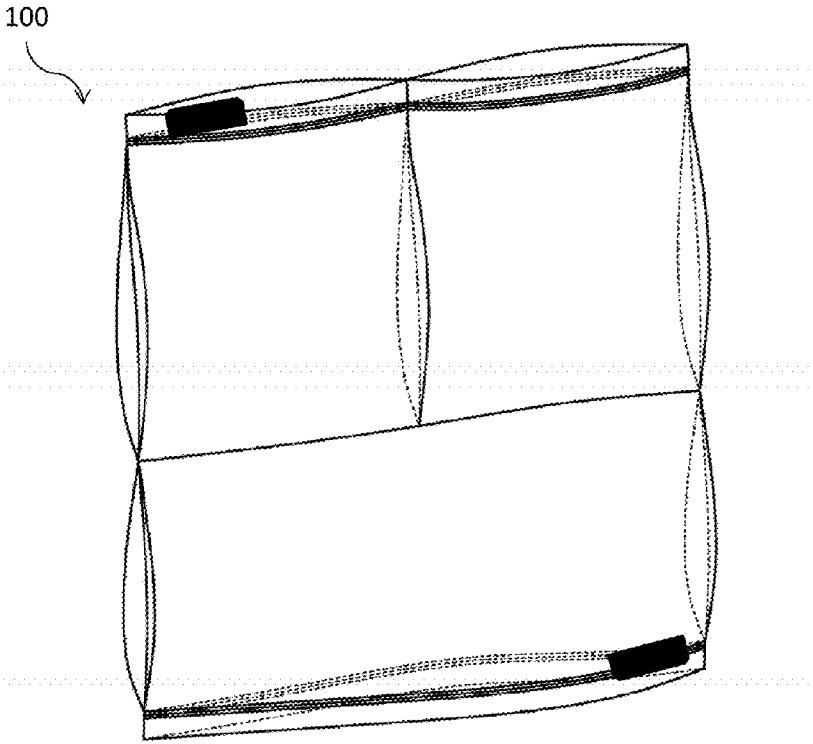
FIG. 2A illustrates a perspective view of the resealable bag of FIG. 1.
Figure 2B:
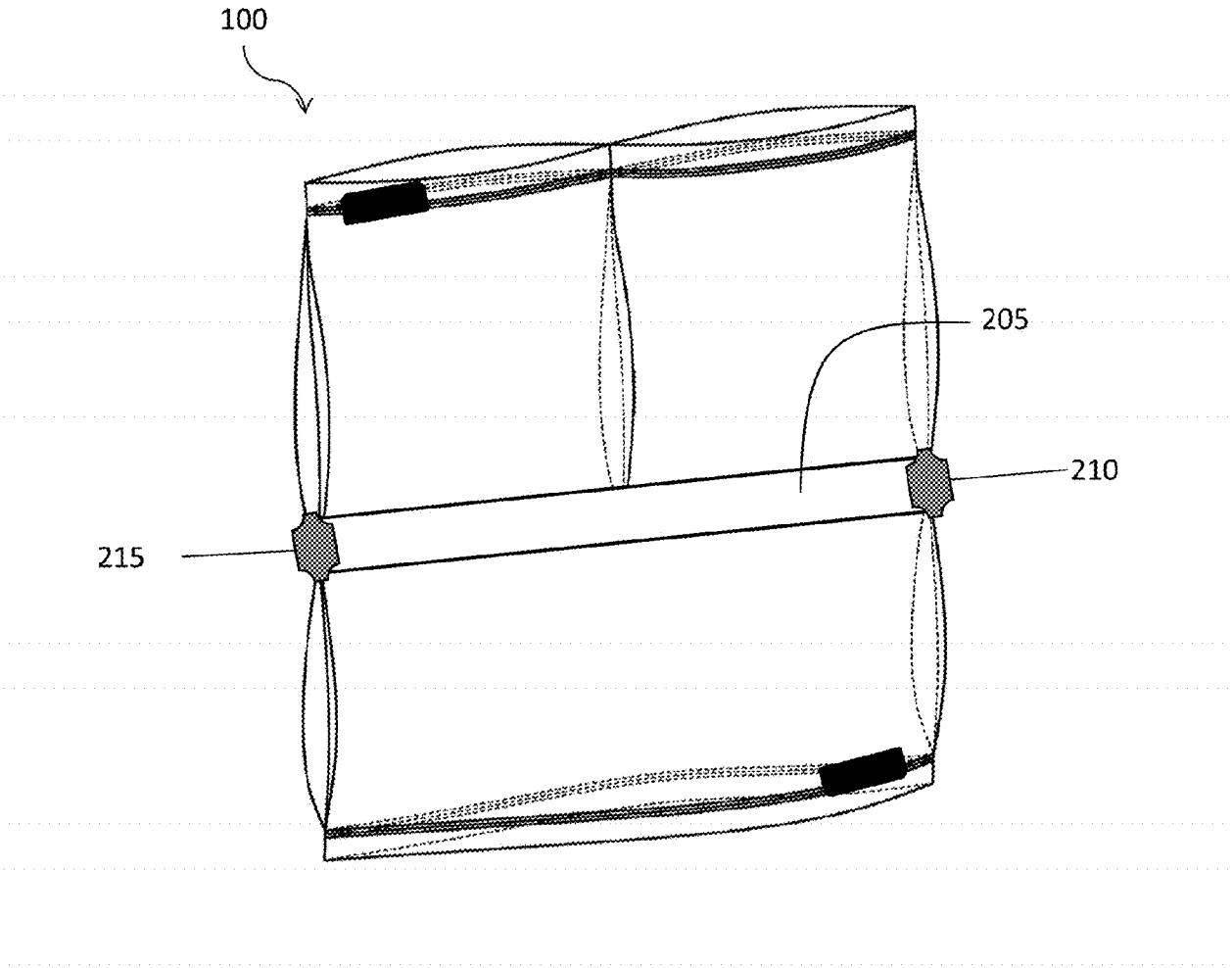
FIG. 2B illustrates the resealable bag of FIG. 1 with an additional chamber.

FIG. 2A illustrates a perspective view of resealable bag 100. FIG. 2B illustrates another implementation of resealable bag 100 that includes a chamber 205. Chamber 205 can separate the upper compartments in resealable bag 100 from the lower compartments and can be used to store condiments (such as ketchup, relish, or mayonnaise), utensils (such as a toothbrush, a skewer, or a knife), and the like. The perimeter of chamber 205 can be sealed such that the contents of the chamber do not mix with the adjacent compartments. Chamber closures 210 and 215 can be removed from resealable bag 100 or reattached to the resealable bag to access the contents of chamber 205. Chamber closures 210 and 215 can be made from twist-off caps, pop-off caps, and the like. Chamber 205 and chamber closures 210 and 215 can be optionally used with any of the resealable bags disclosed herein. In some implementations, chamber 205 can be sub-divided into two separate chambers with a shared plug separating the chambers.

Figure 3:
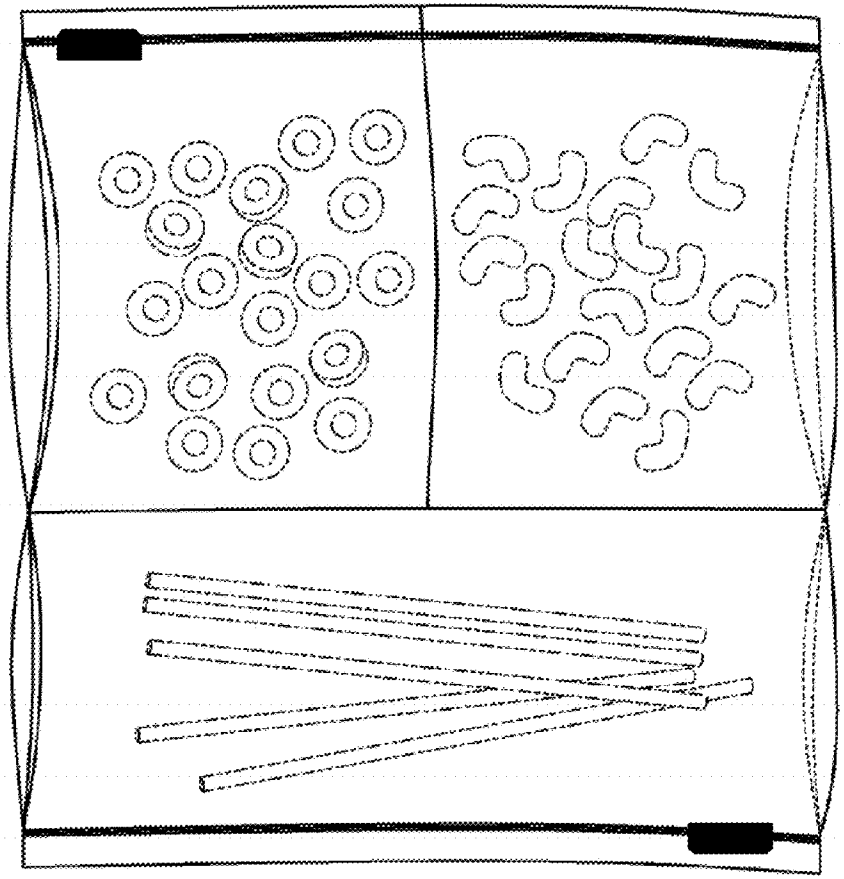
FIG. 3 illustrates the resealable bag of FIG. 1 with items stored in the compartments.

FIG. 3 illustrates an exemplary use of resealable bag 100. In the example of FIG. 3, different types of food may be placed in each compartment.

Figure 4A:
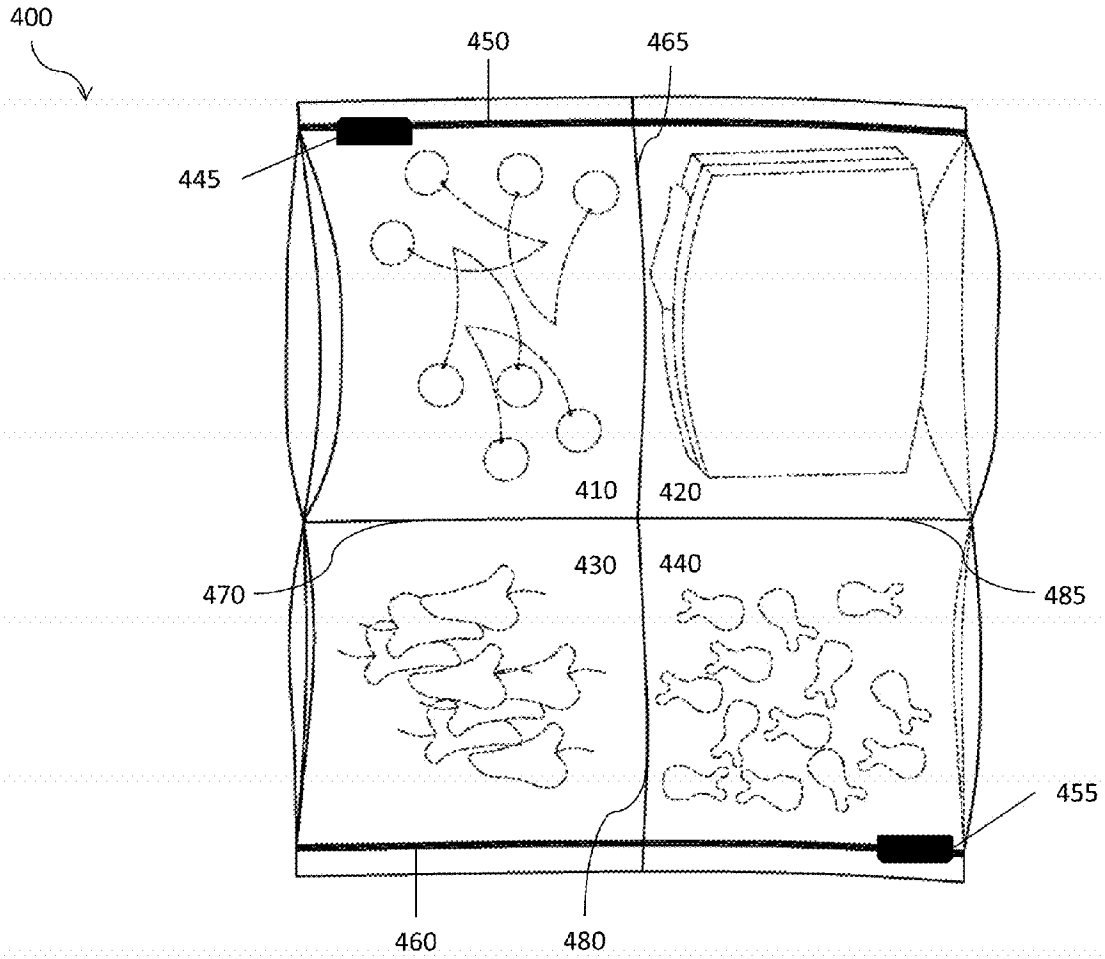
FIG. 4A illustrates a resealable bag having four compartments in a first configuration.

FIG. 4A illustrates an implementation of a resealable bag 400 having four resealable compartments 410, 420, 430, and 440. Compartments 410 and 420 can be positioned along top edge 450, and compartments 430 and 440 can be positioned along bottom edge 460. Seams 465, 470, 480, and 485 can separate compartments 410, 420, 430, and 440 from each other. Resealable element 445 can be moved along top edge 450 to seal and unseal bag 400 so that items can be inserted or removed from compartments 410 and/or 420. Similarly, resealable element 455 can be moved along bottom edge 460 to seal and unseal bag 400 so that items can be inserted or removed from compartments 430 and/or 440.

Figure 4B:
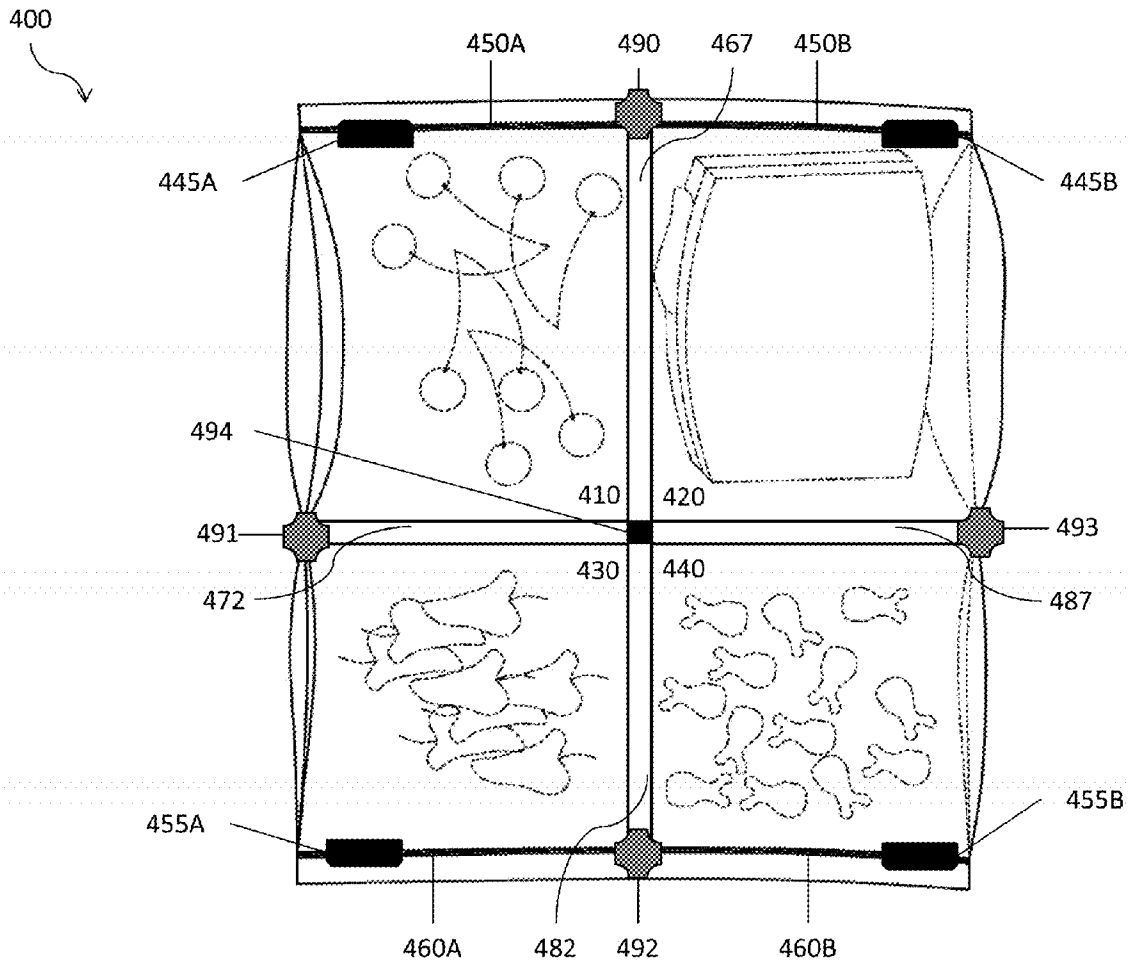
FIG. 4B illustrates the resealable bag of FIG. 4A with additional chambers.

FIG. 4B illustrates another implementation of resealable bag 400 that includes chambers 467, 472, 482, and 487. Various condiments, utensils, and the like can be stored in chambers 467, 472, 482, and 487. Each chamber has a chamber closure 490, 491, 492, or 493 on one end, and a shared plug 494 at the other end. Similar to chamber closures 210 and 215 of FIG. 2B, chamber closures 490, 491, 492, or 493 can be made from twist-off caps, pop-off caps, and the like. Shared plug 494 can be a substantially impermeable structure that prevents the contents of the chambers from mixing with each other.

Chamber closure 490 can separate the top edge of resealable bag 400 into two separate segments 450A and 450B, each segment having its own resealable element (445A or 445B). Similarly, chamber closure 492 can separate the bottom edge of resealable bag 400 into two separate segments 460A and 460B, each segment having its own resealable element (455A or 455B).

Although the implementation of FIG. 4B illustrates the use of four chambers 467, 472, 482, and 487 in resealable bag 400, other variations are possible. For example, in some implementations, only one chamber can be used. This single chamber can, for example, correspond to any one of chambers 467, 472, 482, and 487. Alternatively, this single chamber can span the entire length of the bag (for example, a single chamber that fuses chambers 467 and 482 into a single chamber). In other variations, any two or any three of the chambers can be used in combination with each other.

Although the implementations of FIGS. 4A and 4B use four total compartments (upper and lower portions of resealable bag 400 each having two compartments), other configurations are possible. For example, resealable bag 400 can have six total compartments (upper and lower portions each having three compartments), eight total compartments (upper and lower portions each having four compartments), ten total compartments (upper and lower portions each having five compartments), twelve total compartments (upper and lower portions each having six compartments), fourteen total compartments (upper and lower portions each having seven compartments), sixteen total compartments (upper and lower portions each having eight compartments), and the like. In some implementations, the resealable bag can have a different number of compartments in the upper and lower portions. Moreover, the compartments in the bag can be of the same size or different sizes.

Figure 5:
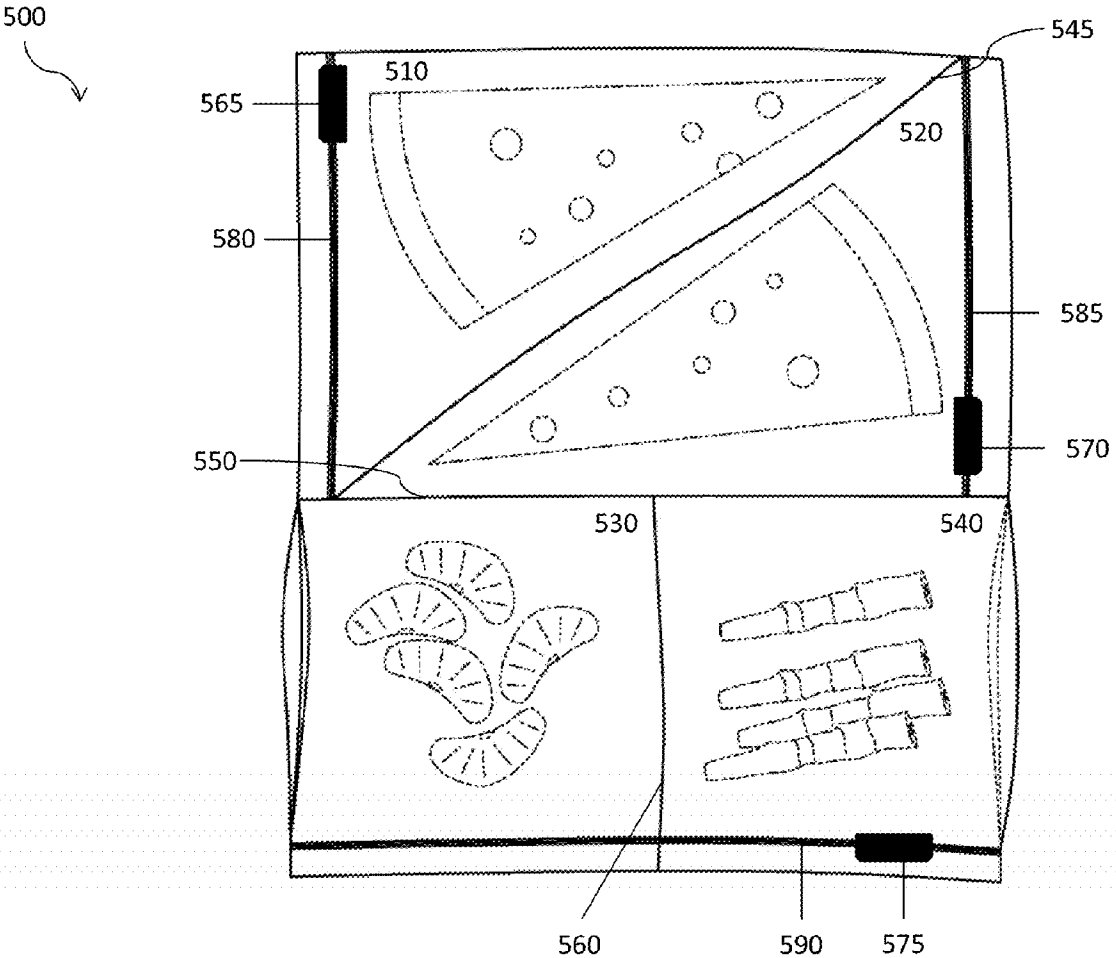
FIG. 5 illustrates a resealable bag having four compartments in a second configuration.

FIG. 5 illustrates another implementation of a bag 500 having four resealable compartments 510, 520, 530, and 540. Unlike the implementation of FIG. 4 which includes two rectangular compartments 410 and 420 in the upper portion of bag 400, the implementation of FIG. 5 can include two triangular compartments 510 and 520 in the upper portion of bag 500. Compartments 510 and 520 can be right triangles that are separated from each other by seam 545. Seam 545 can run along the common hypotenuse of right triangle compartments 510 and 520. A user can access compartment 510 by sealing and unsealing upper left edge 580 using resealing element 565. Similarly, a user can seal and unseal upper right edge 585 using resealing element 570.

Seam 550 can separate compartment 520 from compartments 530 and 540 in the lower portion of bag 500. The lower portion of bag 500 can be similar to the lower portion of bag 400. Seam 560 can separate compartment 530 from compartment 540. A user can access compartments 530 and 540 by sliding resealable element 575 along lower edge 590.

Figure 6B:
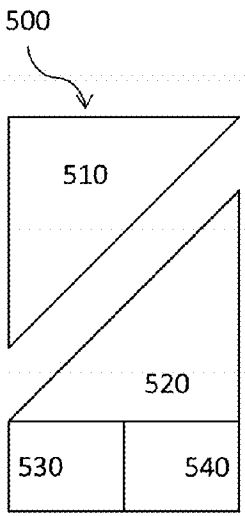
FIG. 6B illustrates the separation of a compartment from a resealable bag.
Figure 6A:
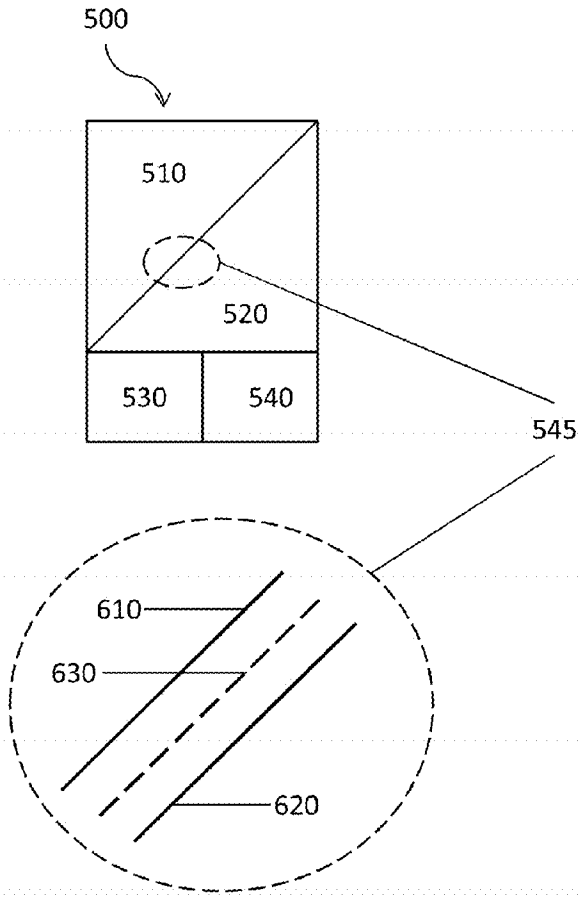
FIG. 6A illustrates a magnified view of a tearable seam.

In the implementations described above, a tear resistant seam can be used to separate the different compartments in a resealable bag. In some implementations, however, the seam can have a perforated edge that enables a user to physically separate compartments from each other by tearing along the seam. FIG. 6A illustrates an implementation of a tearable seam 545 between compartments 510 and 520 in bag 500 of FIG. 5. Although FIG. 6A illustrates a diagonal seam 545, this tearable seam can be used with any of the bags described herein and can enable tears in any direction (i.e., along a horizontal, vertical axis, or at an angle).

FIG. 6A illustrates a magnified view of seam 545 which can include solid seam 610 in compartment 510, solid seam 620 in compartment 520, and perforated seam 630 between the solid seams. When seam 545 is torn along perforated seam 630, compartment 510 can physically separate from bag 500 as illustrated in FIG. 6B. Solid seams 610 and 620 can provide a permanent seal in their respective compartments and can remain unaffected by the tear. Accordingly, solid seams 610 and 620 can keep the contents of compartment 510 and 520, respectively, from spilling out post-separation.

Figure 7:
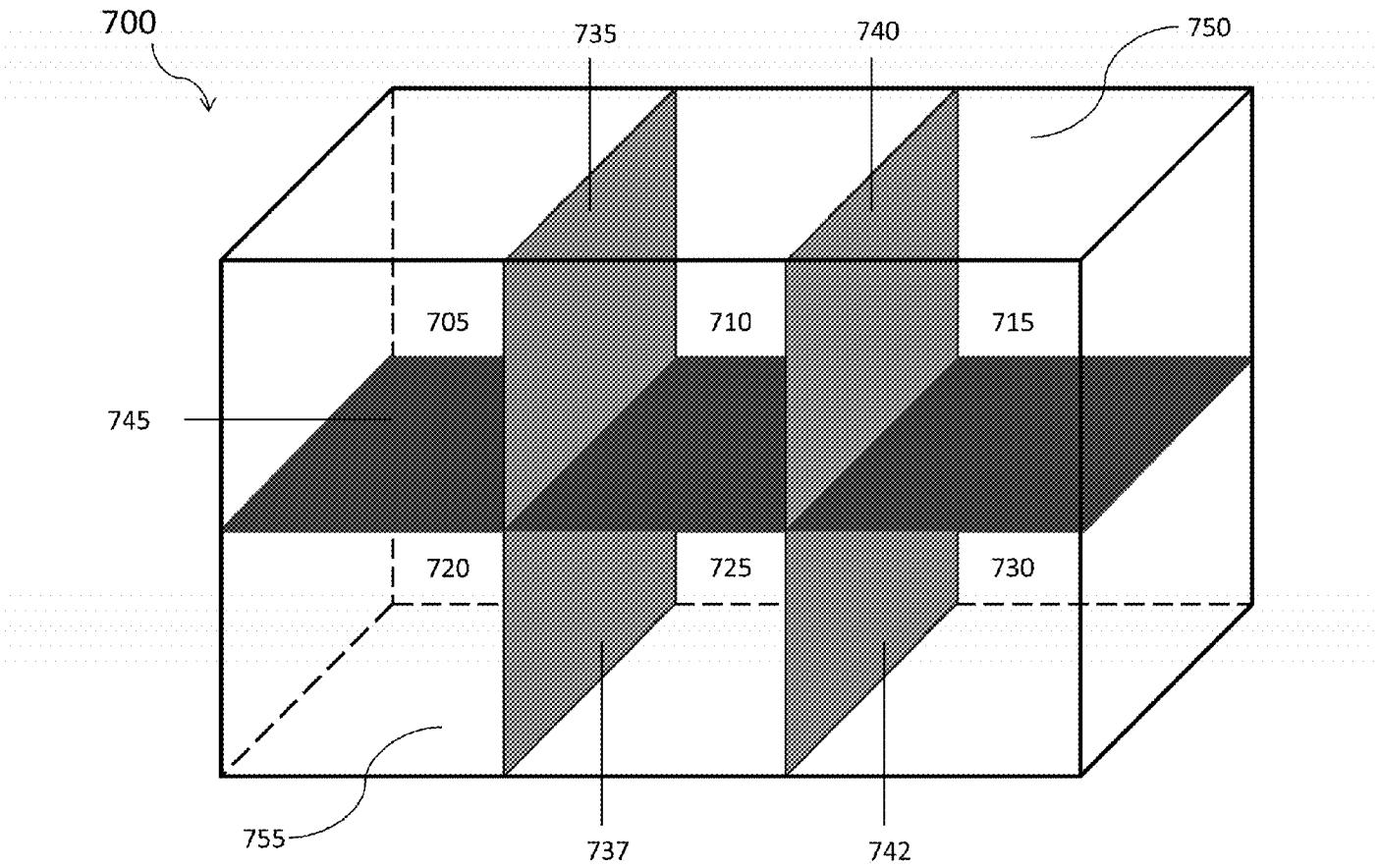
FIG. 7 illustrates a resealable container having six compartments.

FIG. 7 illustrates an implementation of a resealable container 700 having six compartments 705, 710, 715, 720, 725, and 730. Unlike the storage bags described above with respect to FIGS. 1-5 which can be made from a flexible material, container 700 can be made from a substantially rigid material such as hard plastic, glass, pyrex, and the like. Compartments 705, 710, and 715 can be positioned in the upper portion of container 700. Compartments 720, 725, and 730 can be positioned in the lower portion of container 700. Intermediate layer 745 can separate the compartments in the upper portion of the container from the compartments in the lower portion of the container. As explained in further detail below, intermediate layer 745 can either be integral to container 700 or, in some implementations, removable from the container.

Dividers can separate the compartments of container 700 from each other. In the implementation of FIG. 7, divider 735 can be placed between compartments 705 and 710, and divider 740 can be placed between compartments 710 and 715. In the lower portion of container 700, divider 737 can be placed between compartments 720 and 725, and divider 742 can be placed between compartments 725 and 730.

Lids can be used with container 700 to keep the contents of the compartments from falling out. Various configurations are possible including, for example, the use of either a single lid or two lids.

When a single lid is used, the lid can be placed on top of the container in plane 750 and sealed to the container using snap closures, magnetic closures, and the like. Items can be inserted or removed from compartments 705, 710, and 715 by removing the lid. In order to access compartments 720, 725, and 730, intermediate layer 745 can be physically removed from container 700. In some implementations, intermediate layer 745 can contain openings (e.g., slots) that are substantially aligned with the dividers. These openings can allow a user to slide intermediate layer 745 up through container 700. Bottom surface 755 can be a solid surface integral to container 700.

When two lids are used, one lid can be placed on top of the container in plane 750, and a second lid can be placed on the bottom of the container in plane 755. Both top and bottom lids can be sealed to container 700 using one or more snap closures, one or more magnetic closures, and the like. In this implementation, intermediate layer 745 can be an immovable layer integral to container 700 or a removable layer.

Figure 8:
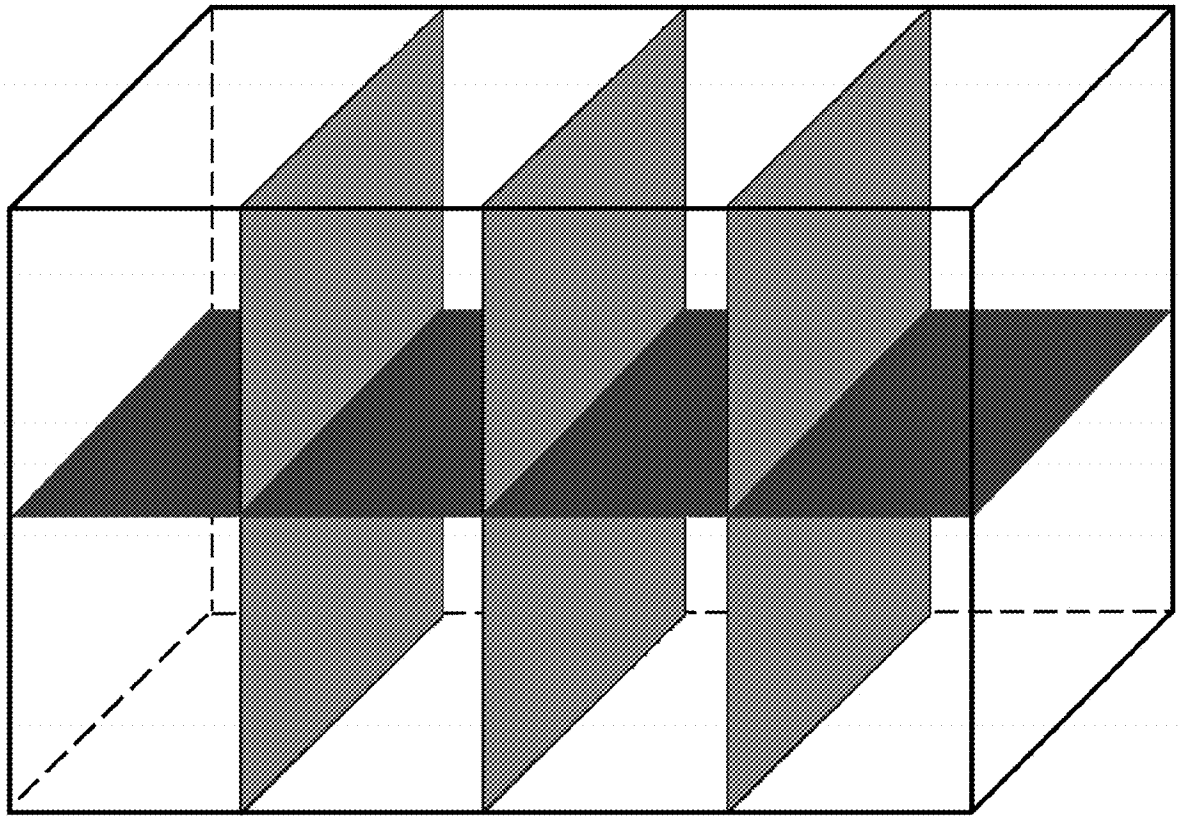
FIG. 8 illustrates a resealable container having eight compartments.
Figure 9:
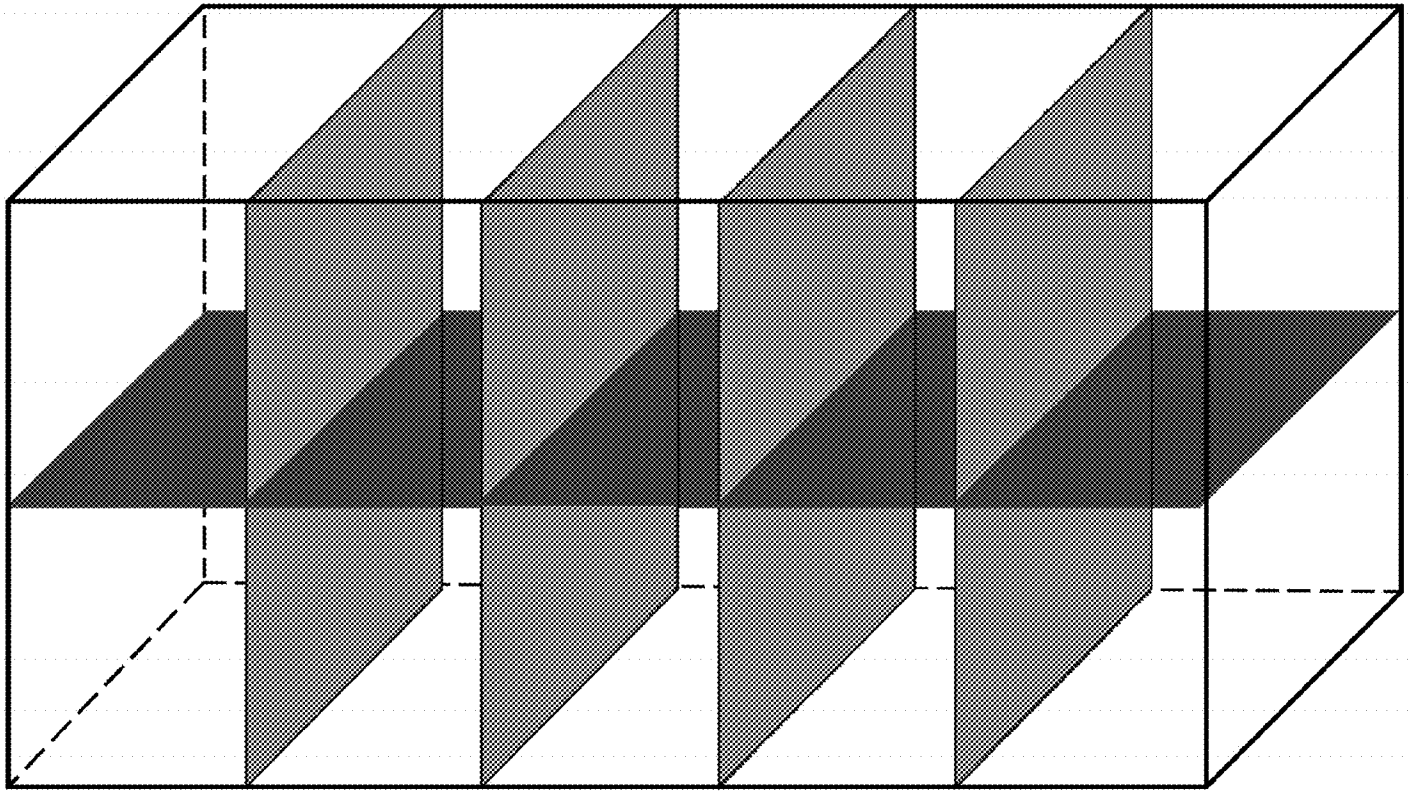
FIG. 9 illustrates a resealable container having ten compartments.
Figure 10:
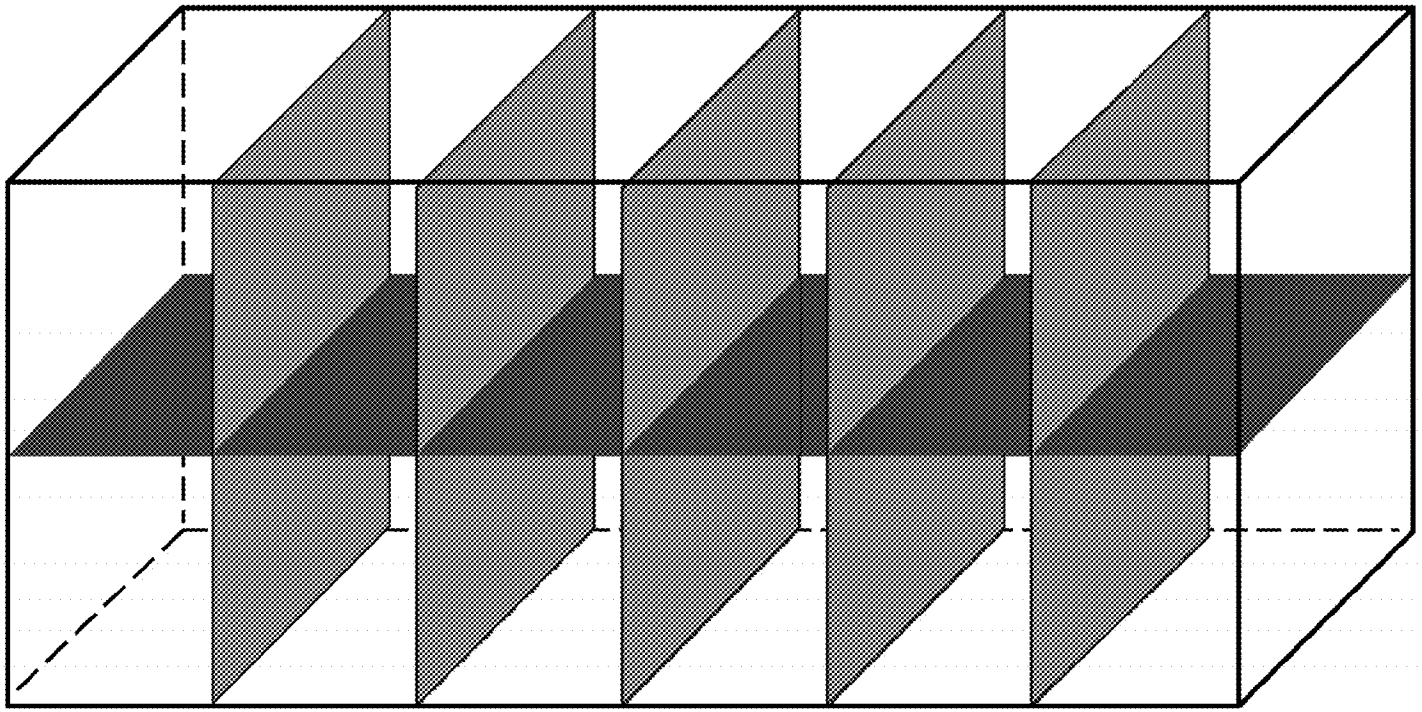
FIG. 10 illustrates a resealable container having twelve compartments.
Figure 11:
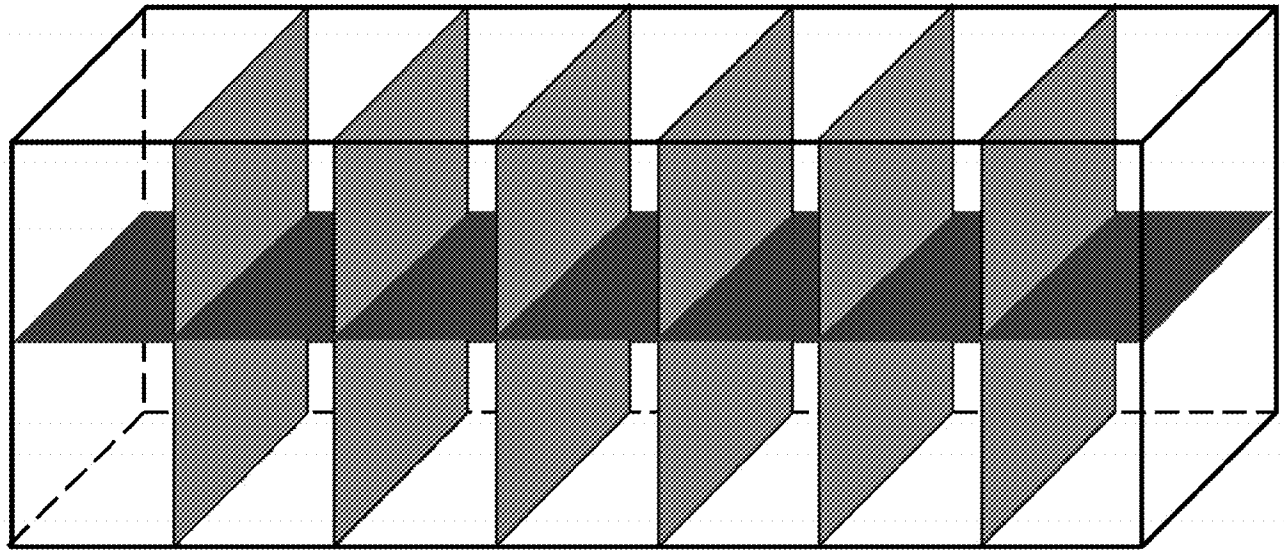
FIG. 11 illustrates a resealable container having fourteen compartments.
Figure 12:
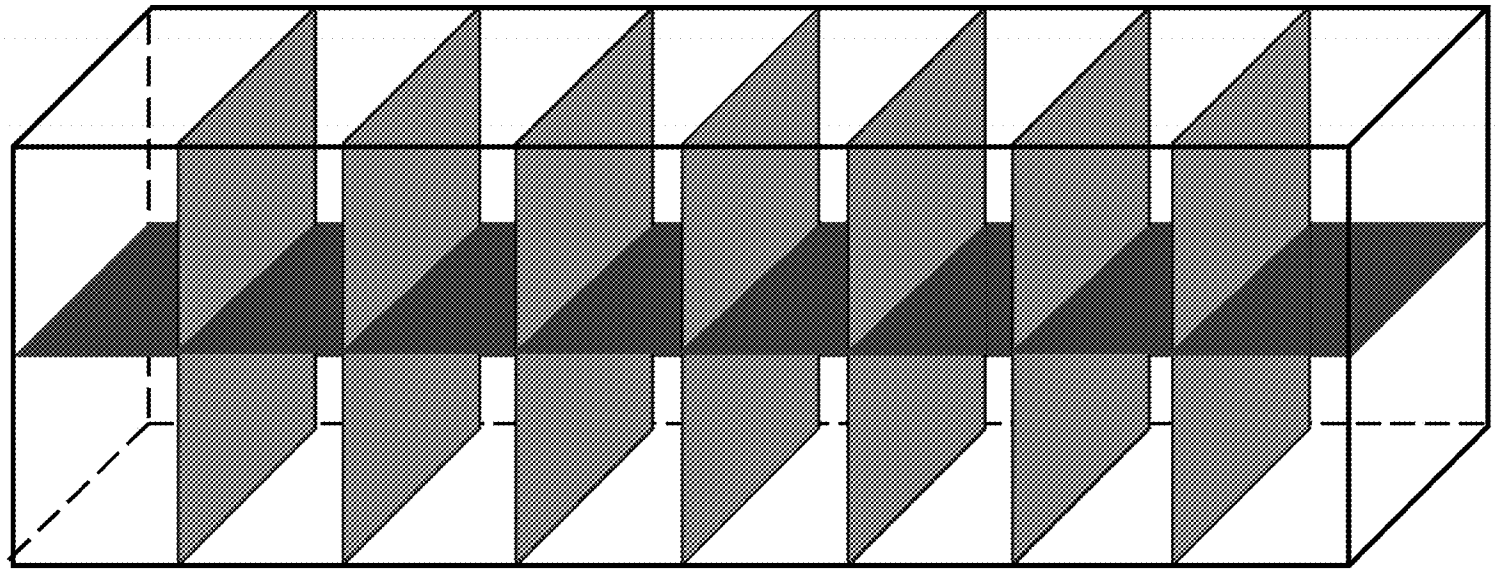
FIG. 12 illustrates a resealable container having sixteen compartments.

Other configurations are possible including, for example, a container having eight compartments as illustrated in FIG. 8, ten compartments as illustrated in FIG. 9, twelve compartments as illustrated in FIG. 10, fourteen compartments as illustrated in FIG. 11, sixteen compartments as illustrated in FIG. 12, and the like. Although the implementations of FIGS. 7-12 illustrate an equal number of compartments in both the upper and lower portions of the container, other configurations are possible including, for example, using a different number of compartments in the upper and lower portions. Moreover, the compartments in the container can be of the same size or different sizes. Container 700, for example, can have 3 different sized compartments in the upper portion and 1 compartment in the lower portion.

Figure 13B:
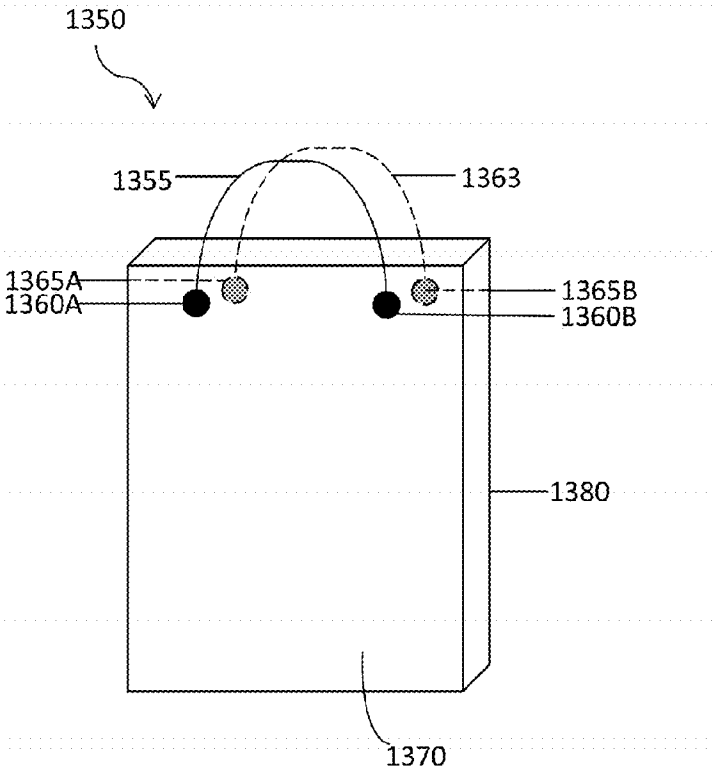
FIGS. 13A and 13B illustrate handles that can be used with a resealable bag/container.
Figure 13A:
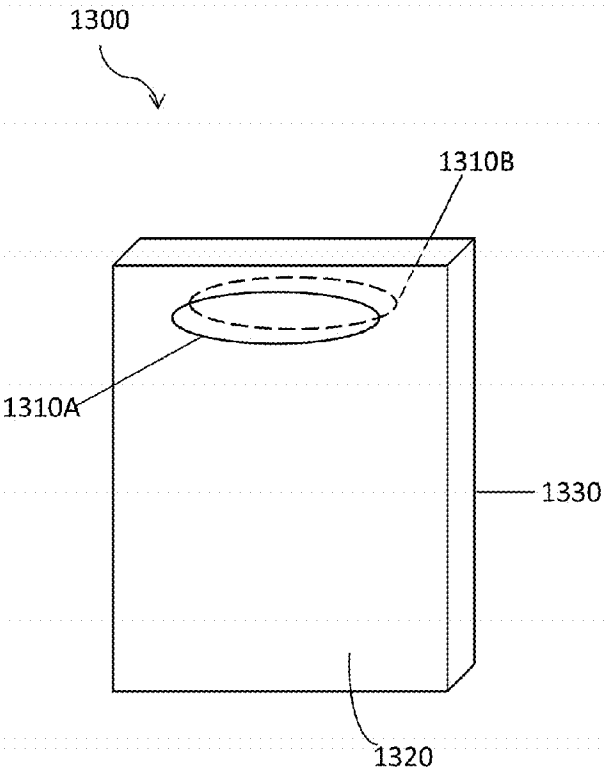

FIGS. 13A and 13B illustrate various handles that can be used with the resealable bags and containers described herein. In the implementation of FIG. 13A, handles 1310A and 1310B can be integral to resealable bag/container 1300 and can be formed by a cutting hole from surface 1320 and another hole from opposing surface 1330. These holes can be substantially aligned with each other such that a person's hand can pass through both holes to grasp bag/container 1300.

In the implementation of FIG. 13B, handles 1355 and 1363 can be attached to resealable bag/container 1350. Unlike the handles of FIG. 13A which are integral to bag 1300, handles 1355 and 1363 can be attached to bag/container 1350. Handles 1355 and 1363 can be made from twisted paper, cardboard, yarn, plastic, and the like. Handle 1355 can be attached to surface 1370 at positions 1360A and 1360B. Handle 1363 can attach to opposing surface 1380 at positions 1365A and 1365B. Positions 1360A and 1365A can be substantially aligned with each other. Likewise, positions 1360B and 1365B can be substantially aligned with each other. Other configurations are possible including, for example, using a single handle or attaching handles 1355 and 1363 to a single surface such as a lid along plane 750 of container 700.

The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. Other implementations may be within the scope of the following claims.

What is claimed is:

1. A storage apparatus comprising:

a multi-compartment bag formed of a flexible material having two or more rectangular compartments in a lower portion of the multi-compartment bag and at least one pair of substantially right triangular compartments in an upper portion of the multi-compartment bag, each compartment of the multi-compartment bag having two or more seams and one resealable opening edge that is sealed or unsealed using a resealing element, at least one resealing element being shared by at least two adjacent compartments, the multi-compartment bag having a front surface, a back surface, and a generally rectangular peripheral edge defined by a top edge, a bottom edge, and opposing side edges, each of the rectangular compartments having their resealable opening edge along the bottom edge of the multi-compartment bag, each of the right triangular compartments being arranged such that their respective hypotenuses are substantially coincident with each other and form a common seam, each of the right triangular compartments having their resealable opening edge along the opposing side edges of the multi-compartment bag perpendicular to the bottom edge of the multi-compartment bag, the seams in each compartment including at least one tearable seam, the tearable seam including a perforated seam positioned between a first solid seam and a second solid seam, the perforated seam configured to physically separate one of the compartments from the multi-compartment bag.

2. The storage apparatus of claim 1, wherein the perforated seam is positioned along a horizontal axis, a vertical axis, or at an angle.

3. The storage apparatus of claim 1, wherein the resealing element is selected from a group consisting of a zippered closure, a press lock, a magnetic closure, a snap closure, and a heat seal.

4. The storage apparatus of claim 1, wherein the flexible material is selected from a group consisting of hemp, cotton, cloth, burlap, mesh, plastic, and a laminated material.

5. The storage apparatus of claim 1, wherein the flexible material is water proof or moisture proof.

6. The storage apparatus of claim 1, further comprising:

a first handle comprising a first hole positioned on the front surface; and a second handle comprising a second hole positioned on the back surface, wherein the first hole and the second hole are substantially aligned with each other.

7. The storage apparatus of claim 1, further comprising:

a first handle attached to the front surface at a front first position and a front second position;

a second handle attached to the back surface at a back first position and a back second position;

wherein the front first position and the back first position are substantially aligned with each other; and wherein the front second position and the back second position are substantially aligned with each other.

8. The storage apparatus of claim 1, wherein the multi-compartment bag further comprises three or more rectangular compartments in the upper portion of the multi-compartment bag and three or more rectangular compartments in the lower portion of the multi-compartment bag.

9. The storage apparatus of claim 1, further comprising:

one or more chambers disposed between the compartments of the multi-compartment bag; and one or more chamber closures removably attached to each of the one or more chambers.

10. The storage apparatus of claim 9, wherein the one or more chamber closures are selected from a group consisting of a twist-off cap and a pop-off cap.

* * * * *